US005415238A

United States Patent [19]

Nice

[11] Patent Number: 5,415,238

[45] Date of Patent: May 16, 1995

[54] BOREHOLE SIDETRACK LOCATOR

[75] Inventor: Sidney B. Nice, Humble, Tex.

[73] Assignee: Western Atlas International, Inc., Houston, Tex.

[21] Appl. No.: 236,522

[22] Filed: Apr. 29, 1994

[51] Int. Cl.[6] ..... E21B 7/06

[52] U.S. Cl. ..... 166/381; 166/117.5

[58] Field of Search ..... 166/117.5, 241.5, 117.6, 166/50, 381

[56] References Cited

U.S. PATENT DOCUMENTS 3,828,853 8/1974 Neal ..... 166/117.5

OTHER PUBLICATIONS

Coiled Tubing Handbook, Edited by: Mark E. Teel; Reprinted fronm World Oil, Gulf Publishing Company, 1993.

*Primary Examiner*—William P. Neuder

*Attorney, Agent, or Firm*—Richard A. Fagin

[57] ABSTRACT

The present invention is an apparatus for guiding a borehole servicing tool string into a sidetrack of a borehole.

In one embodiment, a centralizer displaces a pivotally-mounted housing towards the sidetrack. A rounded nose on the bottom of the housing enables free passage of the housing into the sidetrack.

In an alternative embodiment, a rounded nose is attached to a hinge at the bottom of the housing, and the tool housing is rotatably mounted to the tool string. The nose is displaced axially about the hinge, and the housing is rotated until the nose is aligned with the sidetrack as indicated by an orientation measuring device disposed within the housing.

9 Claims, 5 Drawing Sheets

BOREHOLE SIDETRACK LOCATOR

BACKGROUND OF THE INVENTION

1. Field of the Invention

The present invention relates to the field of servicing boreholes which have been drilled by sidetracking a secondary wellpath, sometimes known as a lateral, from a primary borehole. More specifically, the present invention relates to servicing a desired lateral with a drilling, completion or workover tool assembly, commonly called a tool string, in a well from which multiple laterals may have been drilled.

2. Discussion of the Related Art

The purpose of drilling multiple laterals is to increase total reservoir drainage without incurring the cost of surface casing, surface site preparation and other expenses associated with drilling new wells originating at the earth's surface. Drilling these multiple laterals is known in the art. Multiple laterals are each drilled by re-entering the primary borehole and sidetracking. The primary borehole can either be an uncased or cased well. A lateral is usually drilled so that it is nearly normal to the primary borehole. The lateral is extended until it has achieved sufficient horizontal displacement for enabling the desired additional drainage in the target reservoir. In multiple lateral wells the primary borehole and the sidetracked laterals remain open after they are drilled. They are not plugged or otherwise obstructed, even at the portions of the primary borehole where the sidetracking process is begun, known as the kick-off-point.

Orienting a well drilling or completion tool string to enter a specific lateral in a multiple lateral well is known in the art. Drillpipe and workover tubing are normally used to convey the drilling or completion tools so that they can be oriented to enter the desired lateral. Rotational torque is applied to the drillpipe or tubing at the surface, turning the tool string to the proper orientation for entering the desired lateral, and a bent housing typically located near the bottom of the tool string assists in guiding the tool string into the lateral. However, use of bent housings for guiding drilling and completion tools into a desired lateral has drawbacks. Having sufficient bend angle in the housing to reliably guide the tool string into the lateral can cause difficulty in traversing the primary wellbore since the effective diameter of the tool string is increased by the axial displacement along the bend.

Drillpipe and tubing could also be used to convey an electric wireline tool string, such as production logging instruments or perforating guns, but drillpipe or tubing conveyance of wireline tools is time consuming and expensive. The drillpipe or tubing must be assembled into a continuous length by means of threaded couplings from sections whose length is normally thirty to ninety feet.

In the case of single wellbores without sidetracks, wireline or coiled tubing conveyance methods are commonly used with a high degree of success for running of wireline surveying, evaluation and completion tools. "World Oil's Coiled Tubing Handbook", Gulf Publishing Co., Houston, Tex. 1993, provides detailed descriptions of the use of coiled tubing to convey wireline tools into a single wellbore. With wireline or coiled tubing conveyed tools, however, it is not possible to apply rotational torque to the tool string from the surface. It is, therefore, difficult to orient the wireline tool string using the wireline or coiled tubing alone.

SUMMARY OF THE INVENTION

The present invention is an apparatus for guiding the lower end of a tool string into a sidetrack, or lateral, drilled from a primary borehole. The guiding is accomplished by a generally rounded-shaped nose with a tapered external diameter. The nose is flexibly attached to the lower end of the tool string. Centralizing means axially displace the nose towards the sidetrack, enabling the nose to clear the wall separation between the primary borehole and the sidetrack, thus guiding the tool string into the sidetrack. In one embodiment of the present invention, the centralizing means is disposed at the lower end of an elongated housing. The housing is flexibly attached to the lower end of the tool string. When the housing reaches the kick-off-point of the well, the centralizer locates the central axis of the housing along the displaced axis of the hole, towards the lateral. The nose, which is disposed at the bottom of the housing enables the housing to move freely past the point of wall separation between the primary borehole and the lateral, and thence into the lateral.

In an alternative embodiment of the present invention the nose is attached to a hinge mounted on the bottom of an elongated housing. The housing is rotatably mounted to the bottom of the tool string. The rotatable mount permits movement of the housing about its axis, but the housing and tool string remain in axial alignment. The hinge enables displacement of the nose out of axial alignment with the housing when a means, disposed within the housing, is engaged. A means for measuring the orientation of the housing, and thus the orientation of the axially displaced nose, relative to the compass direction of the lateral, is disposed within the housing. The means for measuring orientation transmits the measurement of the orientation to the surface for display. Means for rotating the housing relative to the tool string are disposed within the housing. The housing is rotated until the indicated nose orientation matches the desired lateral direction. The housing is then lowered into the sidetrack, and the nose is retracted into axial alignment with the housing. The tool string is then lowered to the desired depth in the lateral.

DESCRIPTION OF THE PREFERRED EMBODIMENT

Figure 1:
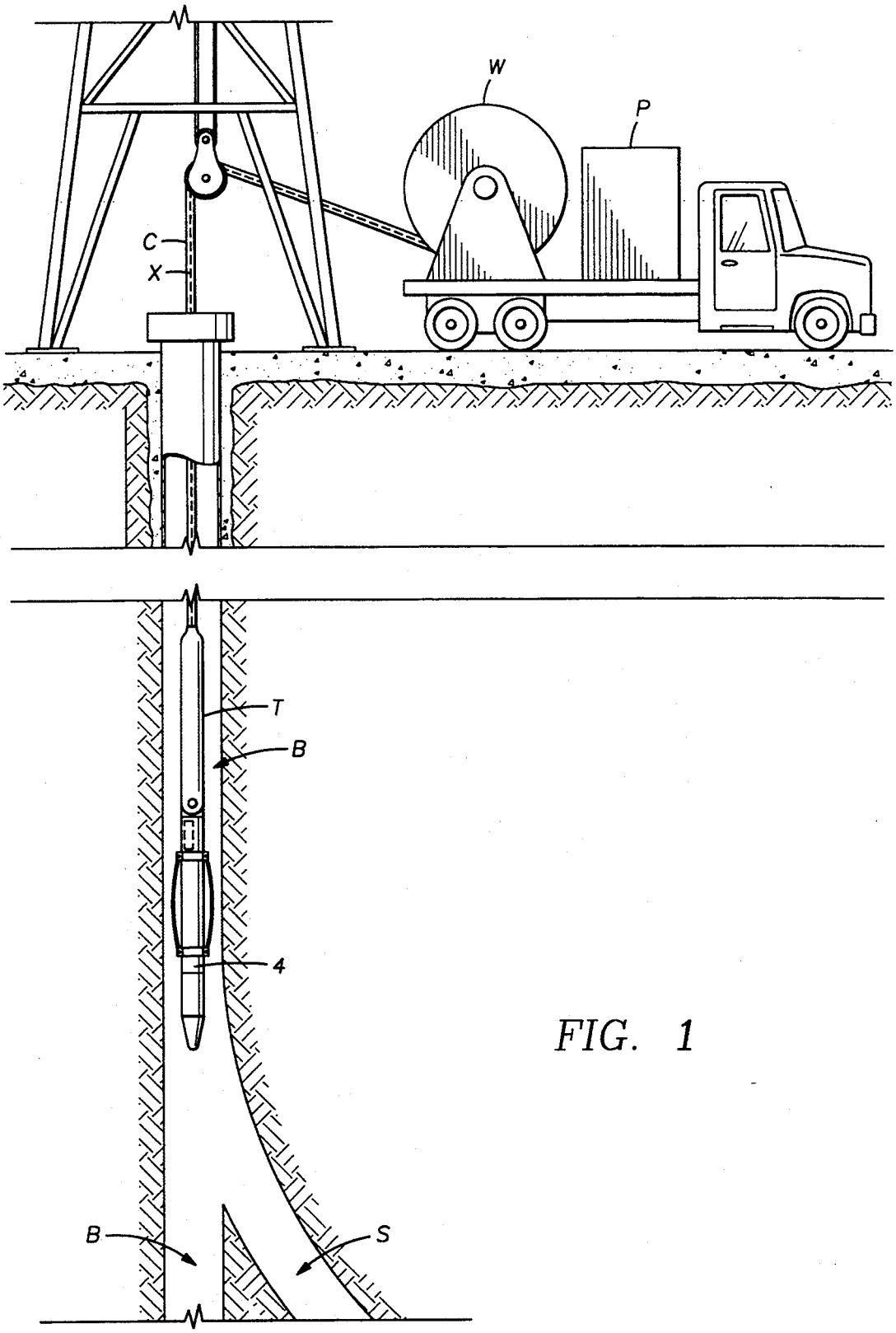
FIG. 1 shows the invention being conveyed by wireline into a borehole with a sidetrack.

Shown in FIG. 1 is a borehole B which has a sidetrack, or lateral S. A tool string T, which may comprise drilling, completion, or wireline tools, is lowered by a coiled tubing C into the borehole B. The coiled tubing is lowered into the wellbore by means of a winch unit W. The coiled tubing C has a coaxially located wireline X traversing the length of the coiled tubing C attached to the tool string T. The wireline X is used for transmission of electrical power and signals between the control panel P, located at the surface, and the tool string T. As more distinctly shown in FIGS. 2 and 3, a housing 4, pivotally mounted to the bottom of the tool string T, is guided into the sidetrack S by a centralizer 2 whose external diameter is enlarged upon command from a surface control panel, enabling the tool string T to travel into the sidetrack S, rather than the primary borehole B.

Figure 2:
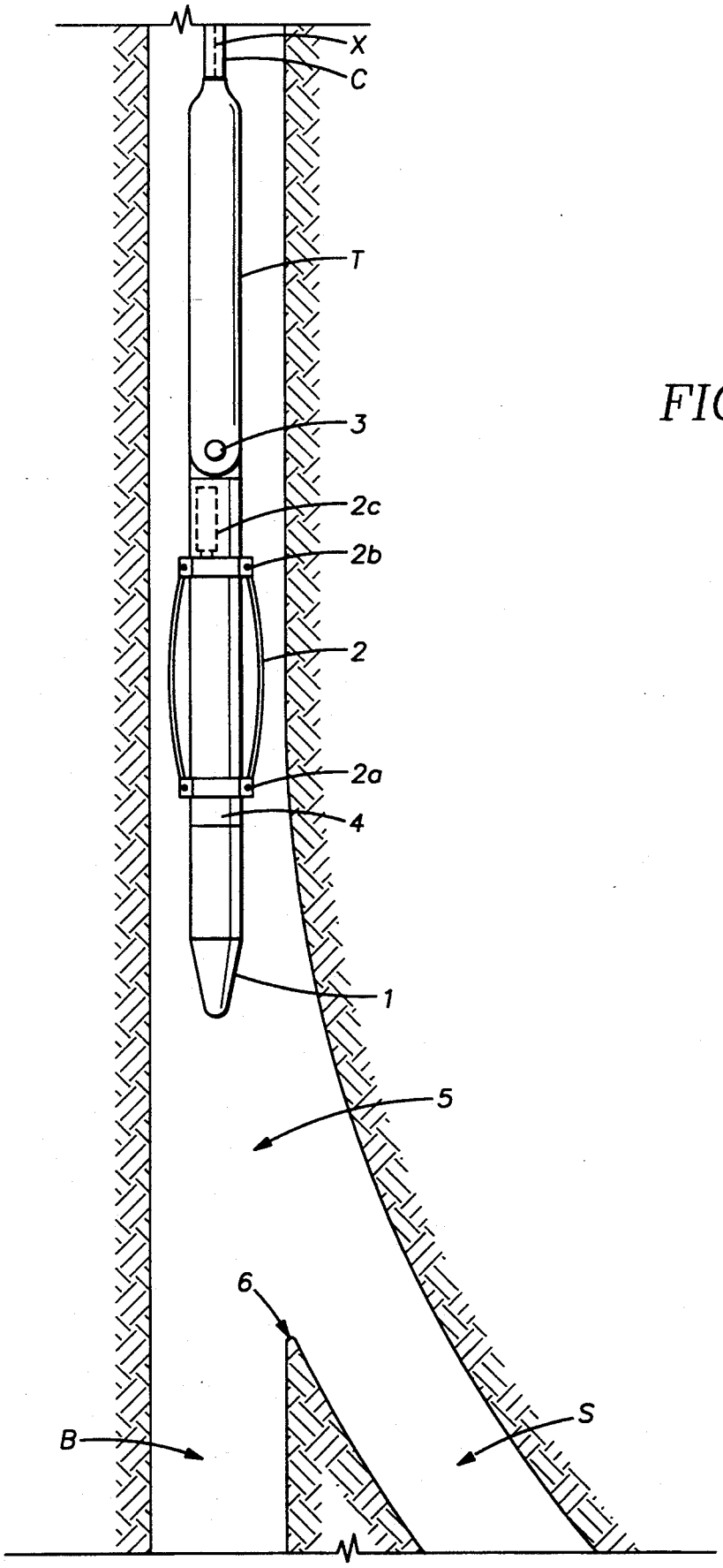
FIG. 2 shows one embodiment of the invention just above the kick-off-point. The centralizer is retracted.

FIG. 2 shows in an expanded view the invention in the borehole B just above the kick-off-point 5 where the main borehole B and the sidetrack S, separate. The housing 4 is flexibly attached to the bottom of the tool string T by a knuckle joint 3. The knuckle joint 3 enables movement of the axis of the housing 4 relative to the axis of the tool string T, but also allows application of axial compressive force upon the housing 4. This compressive force is caused by the weight of coiled tubing (shown as C in FIG. 1) above the tool string.

A bowspring centralizer 2 which in this embodiment can be a three-element type, is mounted externally to the housing 4. These centralizers are known in the art. The centralizer 2 is mounted to the housing 4 by means of two circumferential collars, an upper collar 2*b* and lower collar 2*a*. The upper collar 2*b* is connected to one end of all the spring elements, and the lower collar 2*a* is connected to the other end of the spring elements. The lower mounting collar 2*a* of the centralizer 2 is mounted in a fixed position, by means of set screws, on the exterior of the housing 4. The upper mounting collar 2*b* is mounted to the housing 4 in a manner that permits sliding movement of the upper mounting collar 2*b* along the exterior of the housing 4. Sliding the upper mounting collar 2*b* changes the external diameter of the centralizer 2. The range of diameters of the centralizer 2 can be selected by use of bowspring elements with different unstressed bend radii. The range of diameters should be set to a minimum of about 0.9 times the nominal diameter of the borehole B to a maximum of about 1.5 times the nominal diameter of the borehole B. The upper mounting collar is 2*b* is moved by an hydraulic cylinder and linkage 2*c* disposed within the housing 4. Upon command from the control panel P extension of the hydraulic cylinder 2*c* moves the upper mounting collar 2*b* downward, which increases the external diameter of the centralizer 2 to its maximum.

Figure 3:
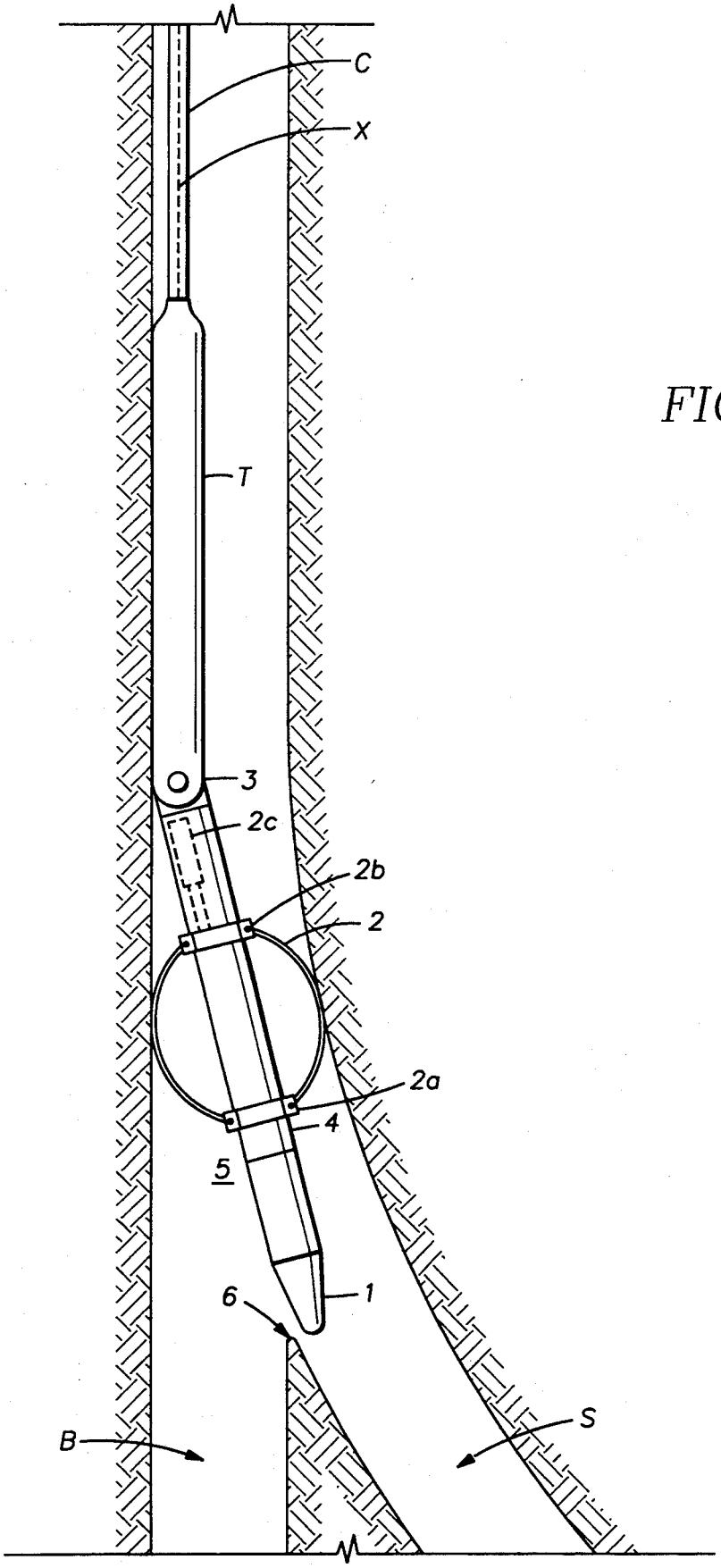
FIG. 3 shows the first embodiment, with centralizer expanded, being deflected into the sidetrack.
Figure 4:
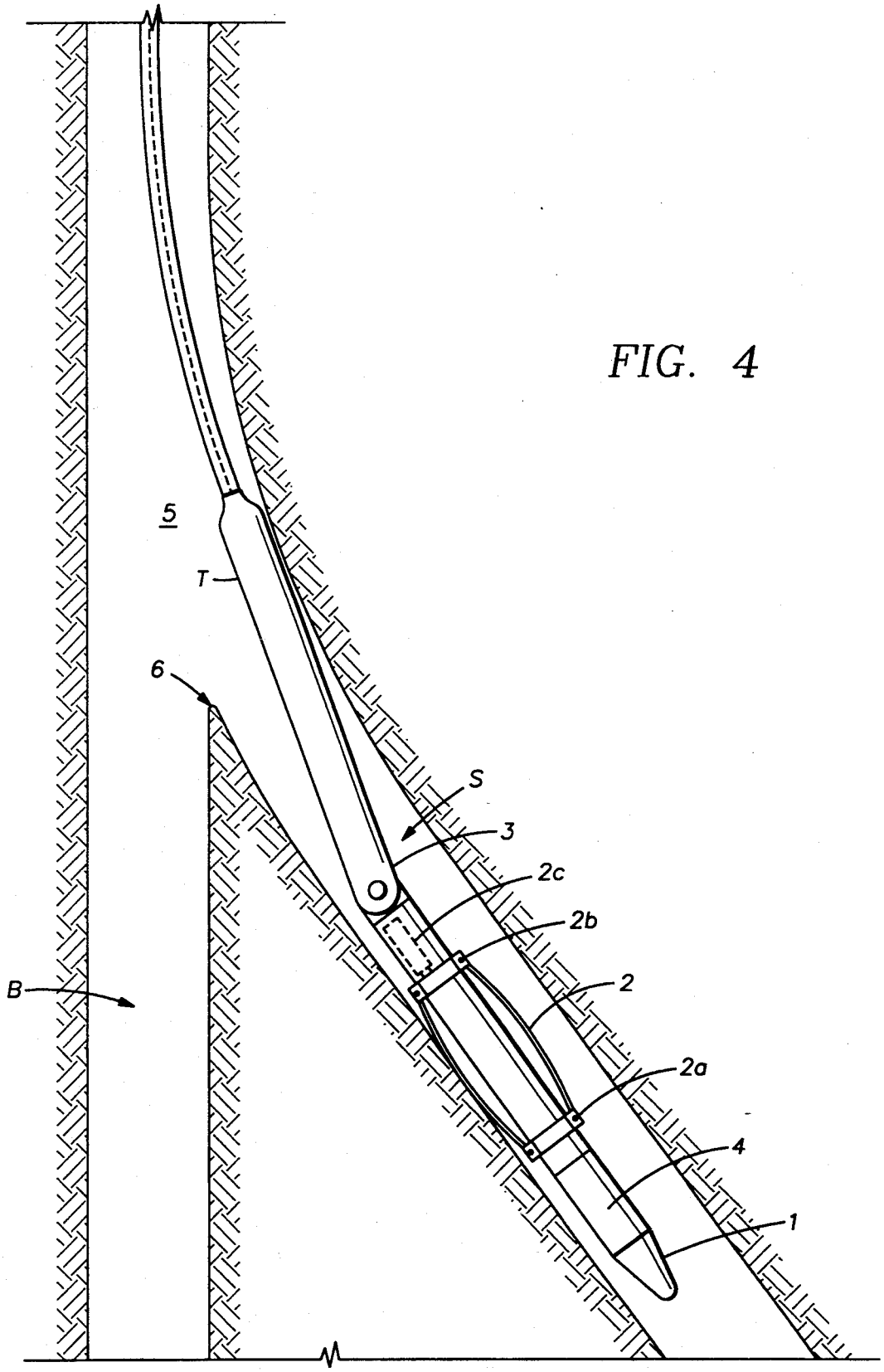
FIG. 4 shows the first embodiment fully inserted into the sidetrack.

A locator nose 1 is attached to the bottom end of the housing 4. The nose 1 is of a generally rounded shape, and has a tapered external diameter with the taper becoming smaller at the lower end of the nose, to enable the nose 1 to travel past the point 6 at which the walls of the borehole B and sidetrack S completely separate. The tool string T is lowered into the borehole B. As depicted in FIG. 3, when the depth of the kick-off-point 5 is reached, the operator sends a command to open the centralizer 2 from the control panel P. The hydraulic cylinder 2*c* is thus extended, causing the centralizer 2 to increase to maximum diameter and occupy the enlarged diameter hole created as a result of the distal wall of the sidetrack S separating from the borehole B at the kick-off-point 5. Because of this wall separation the hole is enlarged, but the central axis of the hole at the kick-off-point 5 is displaced in the direction of the sidetrack S. When the centralizer 2 is enlarged, therefore, its centralizing force will cause rotation of the axis of the housing 4 into alignment with the displaced axis of the enlarged hole at the kick-off-point 5. The knuckle joint 3 enables large axial displacement of the housing 4, since the mass and length to be displaced by the centralizer 2 are significantly reduced relative to that which would have to be displaced in a fully rigid tool string. Axial displacement of the housing 4 enables the nose 1 to enter into the sidetrack S as the tool string is lowered further. The tool string T is lowered into the sidetrack S until the centralizer 2 begins binding on the wall separation point 6. The technique of determining when the binding occurs is known in the art and generally involves observation of the tensile loading of the coiled tubing. The operator then sends a command from the control panel P to retract the hydraulic cylinder 2*c*, which moves the upper collar 2*a* back to its rest position, thereby reducing the external diameter of the centralizer 2 back to the minimum. This enables continued passage of the tool string T into the sidetrack S. FIG. 4 shows the tool string T in the sidetrack S, to illustrate the tool string T passage into the sidetrack S after the centralizer 2 is retracted. After the centralizer 2 is retracted to its smallest external diameter, lowering of the tool string T into the sidetrack S continues until the desired depth is reached.

DESCRIPTION OF AN ALTERNATIVE EMBODIMENT

Figure 5:
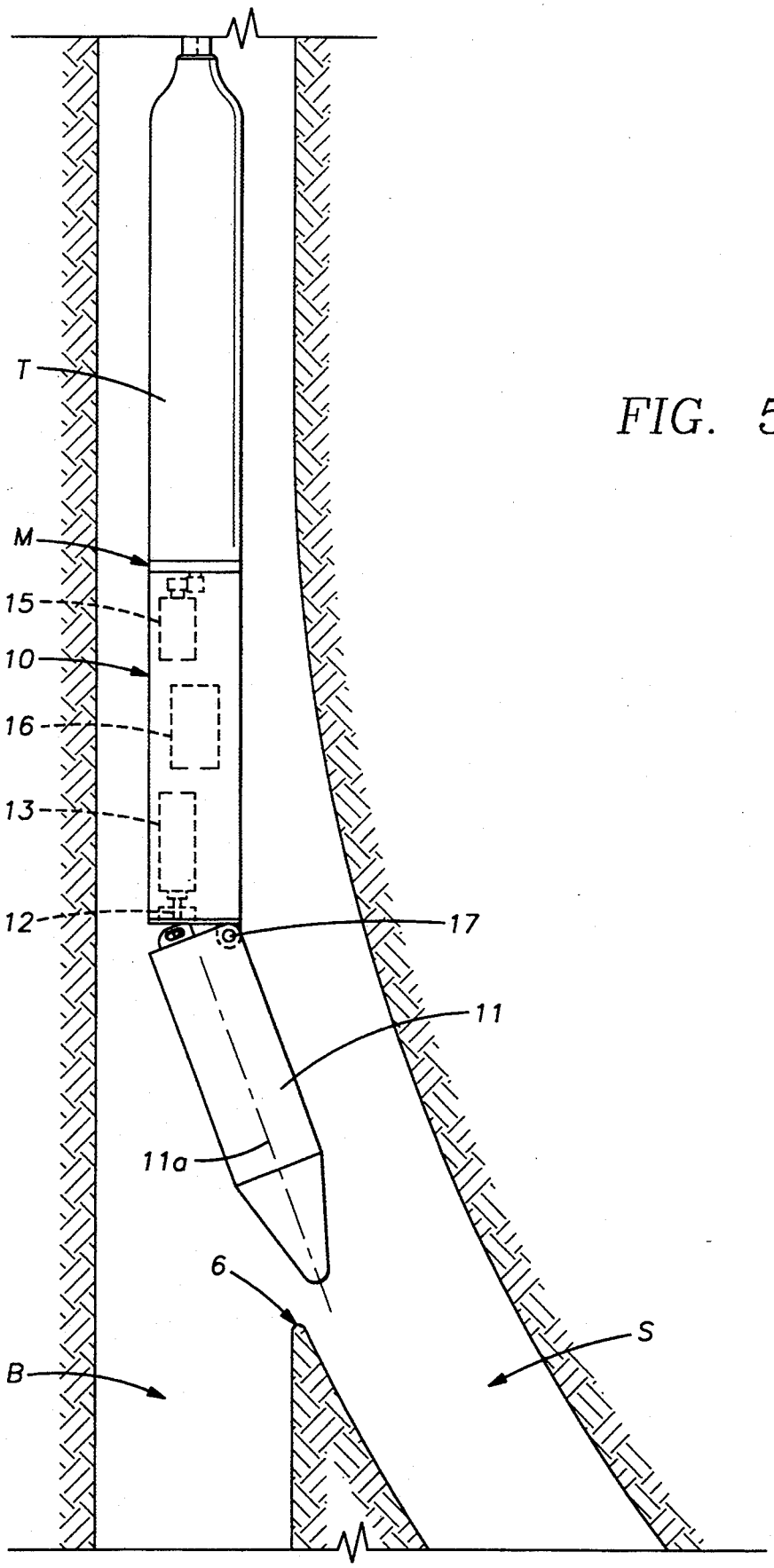
FIG. 5 shows an alternative embodiment of the invention. The nose is deflected into alignment with the entry to the sidetrack.

In FIG. 5, a housing 10 is rotatably mounted to the bottom end of a tool string T, on a mount M, so that rotation is permitted about the axis of the housing 10. Rotation of the housing 10 can be effected by a motor and gear train assembly 15 disposed within the housing. The housing 10 and tool string T remain in axial alignment.

A locator nose 11, similar in configuration to the nose of the first embodiment, is mounted on a hinge 17 attached to the bottom of the housing 10. The hinge enables movement of the nose central axis 11*a* out of axial alignment with the housing 10, but does not allow rotation of the nose 11 relative to the housing 10. The axial motion of the nose 11 is effected by an hydraulic cylinder 13 and linkage 12 disposed within the housing 10. Extension of the cylinder 13 pushes the linkage 12 outward to rotate the nose 11 about the hinge 17.

An orientation measuring device 16, which in this embodiment may be a rate gyroscope, is disposed within the housing 10. This gyroscope 16 measures the orientation of the housing, and therefore, the orientation of the deflected axis of the nose 11*a*, relative to the compass direction of the sidetrack S. The rate gyroscope transmits the measurement of the orientation to the surface for display. The compass direction of the sidetrack is determined by directional surveys taken at the time the sidetrack S was drilled.

The cylinder 13 is activated on command from the control panel P, to deflect the nose 11 axially when the tool string T is at the kick-off-point 5. The motor and gear train assembly 15 is operated also by command from the control panel P until the gyroscope 16 indicates that the axial orientation of the nose 11 matches the direction of the sidetrack S. The tool string T is then lowered into the sidetrack S. The nose 11 is of a generally rounded shape which enables movement of the nose past the wall separation point 6 in the wellbore. When the nose 11 and housing 10 have entered the sidetrack S, the cylinder 13 is retracted upon command from the control panel P, returning the nose 11 to axial alignment with housing 10. The tool string T is then lowered into the sidetrack S to the desired depth.

The embodiments described herein are not the only possible means to achieve the desired operation of the apparatus. For example, the hydraulic cylinder which causes the axial displacement of the locator nose in the alternative embodiment could be replaced with an electric solenoid or an electric motor with a gear transmission. The motor used to rotate the housing could easily be disposed within the bottom of the tool string rather than in the housing itself. Therefore the embodiments described are only intended to illustrate some of the possible means to achieve the invention as claimed, and are in no way intended to limit the scope of the present invention.

I claim:

1. An apparatus for guiding a tool string into a sidetrack of a borehole penetrating an earth formation comprising:

a nose member, said nose member tapered so that the width of said nose member is smaller at the bottom of said nose member than at the top of said nose member;

an elongated housing connected to said nose member for coupling said nose member to the lower end of said tool string; and means for axially deflecting said nose member so as to move the longitudinal axis of said nose member substantially into axial alignment with said sidetrack for enabling said tool string to follow the trajectory of said sidetrack as said tool string is lowered into said borehole.

2. An apparatus for guiding a tool string into a sidetrack of a borehole penetrating an earth formation comprising:

a nose member;

an elongated housing connected to said nose member and adapted for coupling said nose member to the lower end of said tool string;

a hinge connecting the lower end of said housing with the upper end of said nose;

means for rotatably mounting the top of said elongated housing to said tool string;

means for measuring the orientation of said housing;

means for reversibly rotating said nose about said hinge;

means for rotating said housing in response to a measurement of the orientation of said housing so as to align said nose with the direction of said sidetrack so that a rotation of said nose about said hinge will cause said nose to enter said sidetrack as said tool string is lowered in said wellbore, and will cause said tool string thereby to follow the trajectory of said sidetrack.

3. The apparatus of claim 2 wherein said means for rotating said housing comprises an electric motor and a gear mounted within said housing.

4. The apparatus of claim 2 wherein said means for measuring the orientation of said housing comprises a rate gyroscope.

5. The apparatus of claim 2 wherein said means for reversibly rotating said nose comprises an hydraulically powered cylinder.

6. An apparatus for guiding a tool string into a sidetrack of a borehole penetrating an earth formation comprising:

a nose member;

an elongated housing connected to said nose member and adapted for coupling said nose member to the lower end of said tool string;

a pivotal coupling attached to the upper end of said housing and to the lower end of said tool string to allow axial deflection of said housing relative to said tool string; and power actuated, selectively operable means for axially deflecting said housing relative to said tool string, said power actuated means comprising said pivotal coupling and a power actuated, selectively operable means for centralizing said housing within said borehole, whereby selective operation of said centralizing means at the location within said borehole where said sidetrack begins separation from said borehole, and the diameter of said borehole is enlarged, results in a deflection about said pivotal coupling of said housing into axial alignment with said sidetrack.

7. The apparatus as defined in claim 6 wherein said means for centralizing comprises an at least three element bowspring slidably mounted on the exterior of said housing at a first end of said bowspring, and a power actuated selectively operable means for linearly displacing said first end so that operation of said means for linearly displacing results in a change in the external diameter of said bowspring.

8. A method for guiding a tool string into a sidetrack of a borehole penetrating an earth formation, said tool string comprising a housing pivotally attached to the lower end of said tool string, said housing having a nose member disposed at the lower end of said housing, a selectively operable means for axially deflecting said housing relative to said tool string, said method comprising the steps of:

lowering said tool string to a position within said borehole wherein said sidetrack begins separation from said borehole;

operating said means for axially deflecting said housing;

lowering said tool string until said nose member enters said sidetrack;

reversing the operation of said means for axially deflecting said housing; and lowering said tool string to a predetermined depth within said sidetrack.

9. A method for guiding a tool string into a sidetrack of a borehole penetrating an earth formation, said tool string comprising a housing rotatably attached to the lower end of said tool string, a means for measuring the orientation of said housing, said housing having a nose member pivotally attached to the lower end of said housing, a selectively operable means for axially deflecting said nose relative to said tool housing said method comprising the steps of:

lowering said tool string to a position within said borehole wherein said sidetrack begins separation from said borehole:

measuring the orientation of said housing;

rotating said housing until the orientation of said housing substantially matches the orientation of said sidetrack:

operating said means for deflecting said nose member;

lowering said tool string until said nose member enters said sidetrack;

reversing the operation of said means for axially deflecting said nose member; and lowering said tool string to a predetermined depth within said borehole.

* * * * *